US007958693B2

(12) United States Patent
Oyamada et al.

(10) Patent No.: US 7,958,693 B2
(45) Date of Patent: Jun. 14, 2011

(54) BOOM FOR EXCAVATION MACHINE

(75) Inventors: Yasuyuki Oyamada, Chikugo (JP); Keiichi Nishihara, Chikugo (JP); Takahiro Ikeda, Chikugo (JP); Takafumi Nobayashi, Chikugo (JP); Masao Nagata, Chikugo (JP); Saizou Kondou, Chikugo (JP); Masami Miyanishi, Chikugo (JP)

(73) Assignee: Yanmar Co., Ltd., Osaka (JP)

( * ) Notice: Subject to any disclaimer, the term of this patent is extended or adjusted under 35 U.S.C. 154(b) by 169 days.

(21) Appl. No.: 12/282,844

(22) PCT Filed: Aug. 25, 2006

(86) PCT No.: PCT/JP2006/316720

§ 371 (c)(1),
(2), (4) Date: Oct. 8, 2008

(87) PCT Pub. No.: WO2007/105327

PCT Pub. Date: Sep. 20, 2007

(65) Prior Publication Data

US 2009/0078667 A1 Mar. 26, 2009

(30) Foreign Application Priority Data

Mar. 13, 2006 (JP) ..... 2006-067818

(51) Int. Cl.
*E04C 3/00* (2006.01)

(52) U.S. Cl. ..... 52/831; 52/115; 52/116; 52/117

(58) Field of Classification Search ..... 52/111, 52/112–121, 831–857; 212/247
See application file for complete search history.

(56) References Cited

U.S. PATENT DOCUMENTS 2,500,815 A * 3/1950 Gerli et al. ..... 182/2.7
2,711,078 A * 6/1955 Guild ..... 173/195
3,278,046 A * 10/1966 Shumaker ..... 212/247
3,330,420 A * 7/1967 Walker ..... 212/247
3,918,742 A * 11/1975 Gaibler et al. ..... 280/764.1

(Continued)

FOREIGN PATENT DOCUMENTS

JP 7-20335 4/1995

(Continued)

OTHER PUBLICATIONS

International Search Report for International Appl. No. PCT/JP2006/316720 filed Aug. 25, 2006, Japanese Patent Office, mailed Oct. 3, 2006, 2 pgs.

(Continued)

*Primary Examiner* — Brian E Glessner
*Assistant Examiner* — Adam Barlow
(74) *Attorney, Agent, or Firm* — Sterne, Kessler, Goldstein & Fox P.L.L.C.

(57) ABSTRACT

In a boom 15 for a working machine 10 attached to an upper rotational body 30 supported on a center of an upper portion of a crawler-type traveling device 40 to be transversely rotatable, the boom 15 includes, as portions cast by integral molding, a boom support point part 16, a boom cylinder rod support point part 18, and an arm support point part 19, and is configured so that the boom support point part 16 is connected to the boom cylinder rod support point part 18 by a general-purpose first rectangular pipe 61, and so that the boom cylinder rod support point part 18 is connected to the arm support point part 19 by a general-purpose second rectangular pipe 62.

6 Claims, 6 Drawing Sheets

U.S. PATENT DOCUMENTS

| | | | | |
|---|---|---|---|---|
| 4,193,734 | A * | 3/1980 | Williams | 414/694 |
| 4,244,447 | A * | 1/1981 | Hanitz | 184/6.22 |
| 4,337,868 | A * | 7/1982 | Gattu | 212/348 |
| 4,382,743 | A * | 5/1983 | Newell | 414/692 |
| 4,676,340 | A * | 6/1987 | Correll, Jr. | 182/2.4 |
| 5,375,348 | A | 12/1994 | Kishi | |
| 5,515,654 | A * | 5/1996 | Anderson | 52/118 |
| 5,678,708 | A * | 10/1997 | Forsberg et al. | 212/349 |
| 5,806,313 | A | 9/1998 | Koshi et al. | |
| 6,158,949 | A | 12/2000 | Walth et al. | |
| 6,572,323 | B2 * | 6/2003 | Schupback | 414/722 |
| 7,165,929 | B2 * | 1/2007 | Janes et al. | 414/722 |
| 7,223,061 | B2 * | 5/2007 | Gelb | 414/680 |
| 2009/0129908 | A1 | 5/2009 | Oyamada et al. | |
| 2010/0260539 | A1 * | 10/2010 | Sakamoto et al. | 403/294 |

FOREIGN PATENT DOCUMENTS

| | | | |
|---|---|---|---|
| JP | 11-158908 | | 6/1999 |
| JP | 11-200397 | A | 7/1999 |
| JP | 2000-248572 | | 9/2000 |
| JP | 2000-248576 | A | 9/2000 |
| JP | 2003-261956 | A | 9/2003 |
| JP | 2004-108055 | | 4/2004 |
| JP | 2004-211505 | A | 7/2004 |
| JP | 2005-163375 | A | 6/2005 |

OTHER PUBLICATIONS

International Search Report for Application No. PCT/JP2006/316717, Japanese Patent Office, mailed Sep. 12, 2006, 2pgs.

* cited by examiner

BOOM FOR EXCAVATION MACHINE

BACKGROUND OF THE INVENTION

1. Field of the Invention

The present invention relates to a technique for a structure of a boom constituting a working machine in an excavation machine typified by a power shovel or the like.

2. Background Art

A power shovel is an excavation machine well known as a hydraulic shovel excavation machine. The power shovel is basically structured to include a self-propelled lower traveling body and an upper rotational body rotatable by 360 degrees on the lower traveling body. The upper rotational body includes a boom and an arm, and an attachment such as a bucket is attached to the boom and the arm. Generally, in relation to the power shovel, the boom, the arm, and the bucket are generically referred to as "operating part" and the boom and the arm are generally referred to as "front".

The boom is a cylindrical structure including three support point parts of an arm support point part, a boom support point part, and a boom cylinder rod support point part. To create a space in which the attachment can rotate during an excavation operation, the boom is foamed into a "dogleg" shape in a side view. An arm cylinder actuating the arm is arranged above the boom.

To keep balance while the power shovel operates and to resist a load during the excavation operation, it is considered that the boom needs to have a strength and to be reduced in weight. Conventionally, a boom configured to bond left and right side plates to upper and lower plates by welding and to have a rectangular cross section has been most popular. In such a boom, a cross-sectional area of a central portion that requires strength is made large. A boom having a triangular cross section and a boom having a generally trapezoidal cross section (for example, Patent Document 1) are also well known.

Patent Document 1: Japanese Patent No. 3165483

BRIEF SUMMARY OF THE INVENTION

Problem to be Solved by the Invention

However, it takes considerably long operation time and labor to manufacture the side plates having a larger width at a central portion and formed into the "dogleg" shape and the like and to bond these side plates by welding. Consumption of component cost and manufacturing cost means consumption of manufacturing cost.

Problems to be solved are, therefore, to reduce manufacturing cost and manufacturing man-hours of a boom constituting a working machine in an excavation machine.

Means Adapted to Solve the Problems

The problems to be solved by the present invention are those stated above. Means adapted to solve the problems will next be described.

Namely, according to the present invention, there is provided a boom for a working machine attached to an upper rotational body supported on a center of an upper portion of a crawler-type traveling device and transversely rotatable, wherein the boom includes, as portions cast by integral molding, a boom support point part; a boom cylinder rod support point part; and an arm support point part, and is configured so that the boom support point part is connected to the boom cylinder rod support point part via a first straight part having constant transverse and longitudinal dimensions over an entire length and having a rectangular cross section, and so that the boom cylinder rod support point part is connected to the arm support point part via a second straight part having constant transverse and longitudinal dimensions over an entire length and having a rectangular cross section.

Furthermore, according to the present invention, in the boom, transverse and longitudinal dimensions of the rectangular cross sections of the general-purpose first rectangular pipe and the general-purpose second rectangular pipe are identical to each other.

Moreover, according to the present invention, in the boom, each of the first straight part and the second straight part is constituted by cutting a general-purpose rectangular pipe having a rectangular cross section of constant transverse and longitudinal dimensions over an entire length by an arbitrary length.

Effect of the Invention

The present invention exhibits following advantages.

According to the present invention, in the configuration of the boom for the excavation machine, the straight part other than the integrally molded cast portions can be made simple in shape and can be produced only by cutting the general-purpose rectangular pipe by a necessary length. Namely, the number of components of the boom can be decreased. By adopting the general-purpose rectangular pipe and decreasing the number of components, component cost can be reduced. Further, by using the general-purpose rectangular pipe, the number of welded portions is decreased and manufacturing man-hours can be, therefore, reduced.

Furthermore, according to the present invention, besides the above-stated advantages, the same general-purpose rectangular pipes can be used for the first and second straight parts constituting the boom by making rectangular cross sections of the first straight part the second straight part identical in transverse and longitudinal dimensions. It is, therefore, possible to further decrease the number of components.

Moreover, according to the present invention, besides the above-stated advantages, a plurality of booms at lengths according to excavation machines on which the booms are mounted, respectively can be produced easily at low cost only by cutting the general-purpose rectangular pipes having rectangular cross sections of constant sizes transversely and longitudinally over the entire lengths each by an arbitrary length to produce the first and second straight part respectively. Namely, versatility of the boom in the excavation machine can be improved.

DETAILED DESCRIPTION OF THE INVENTION

An embodiment of the present invention will next be described.

Figure 1:
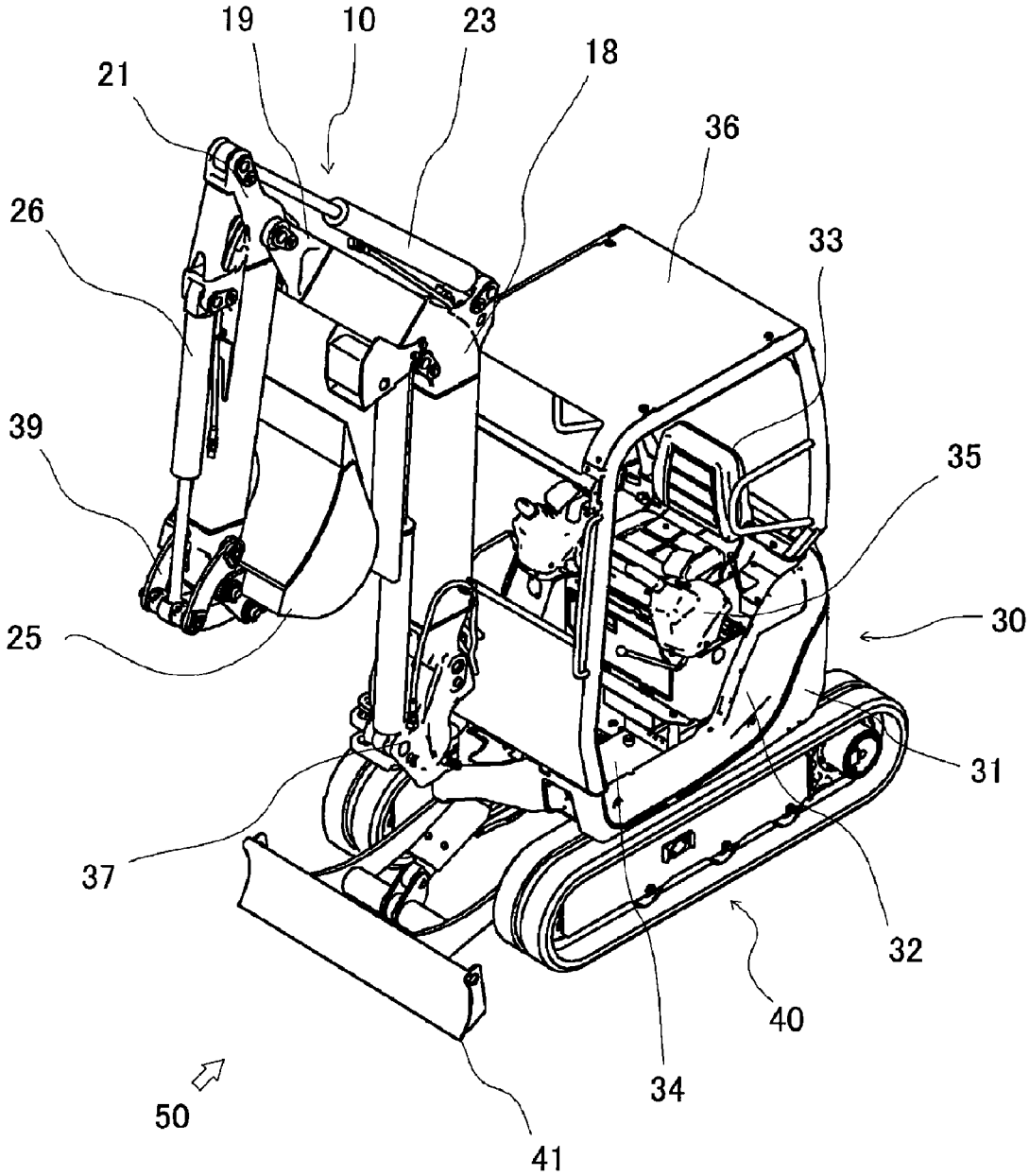
FIG. 1 is a perspective view showing an overall configuration of a power shovel according to an embodiment of the present invention.
Figure 2:
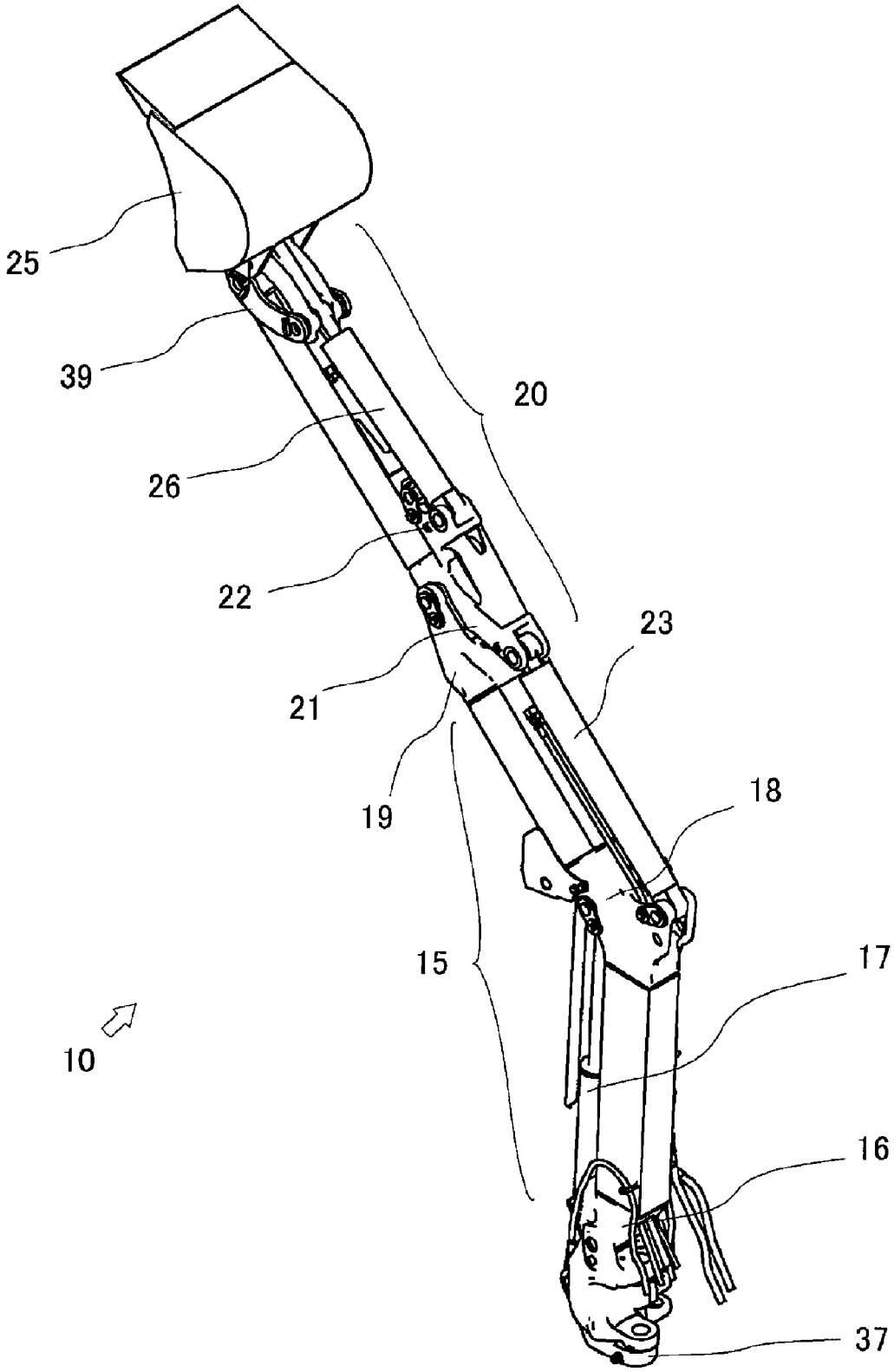
FIG. 2 is a perspective view showing a configuration of a working machine according to the embodiment of the present invention.
Figure 3:
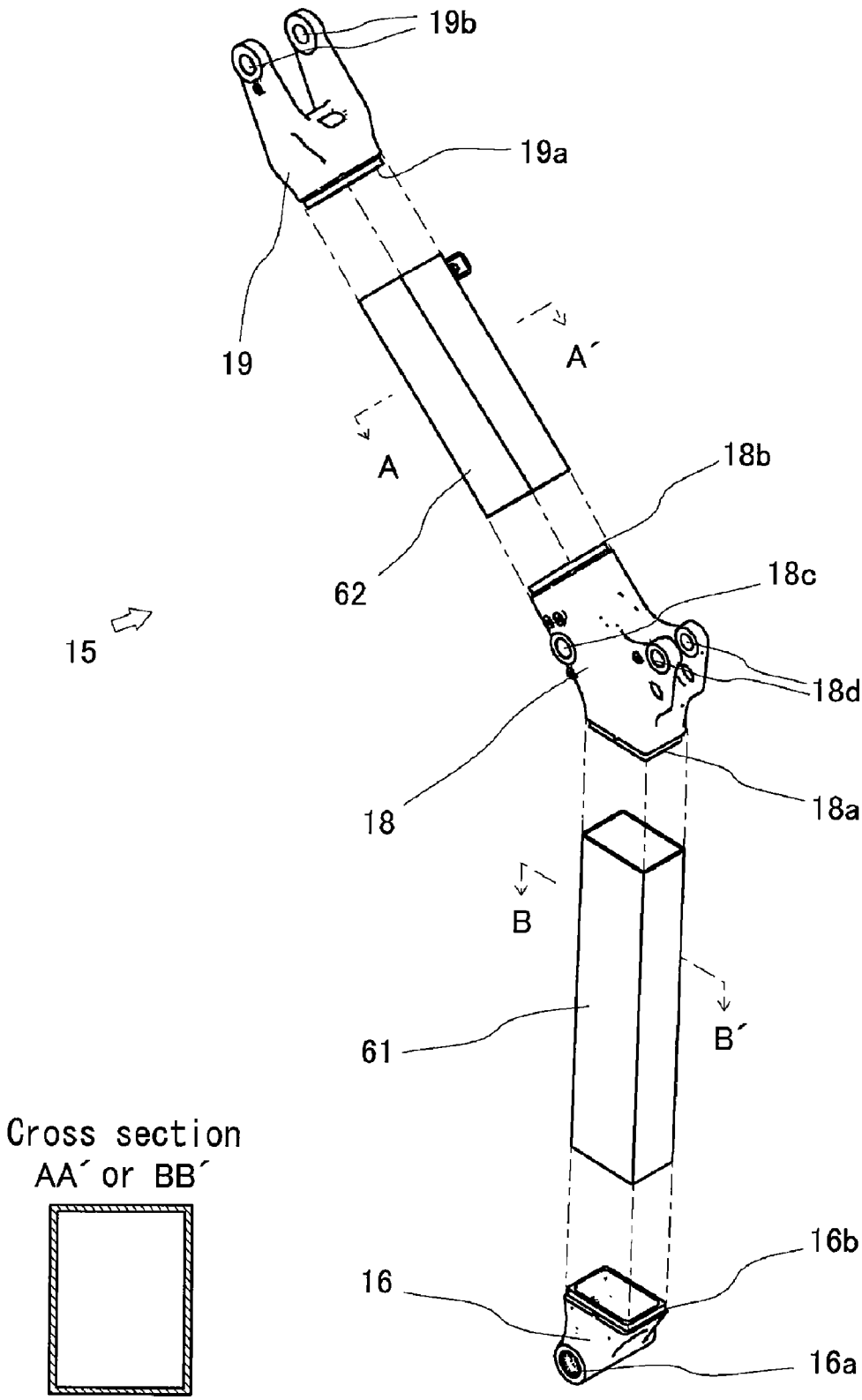
FIG. 3 is a perspective view showing a configuration of a boom and a cross-sectional view of straight parts according to the embodiment of the present invention.

FIG. 1 is a perspective view showing an overall configuration of a power shovel according to an embodiment of the present invention. FIG. 2 is a perspective view showing a configuration of a working machine according to the embodiment of the present invention. FIG. 3 is a perspective view showing a configuration of a boom and a cross-sectional view of straight parts according to the embodiment of the present invention.

Figure 4:
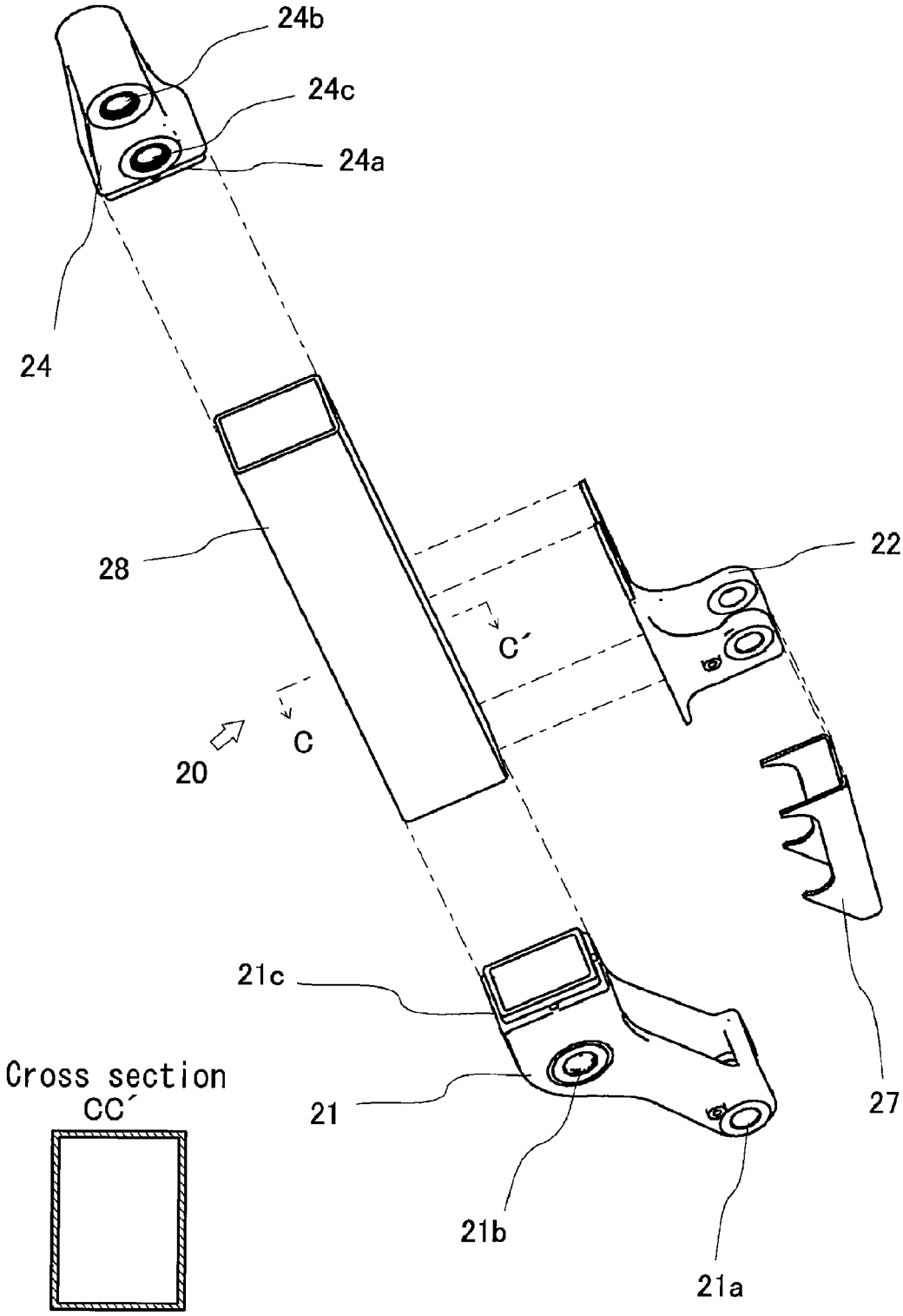
FIG. 4 is a perspective view showing a configuration of an arm and a cross-sectional view of a straight part according to the embodiment of the present invention.
Figure 5:
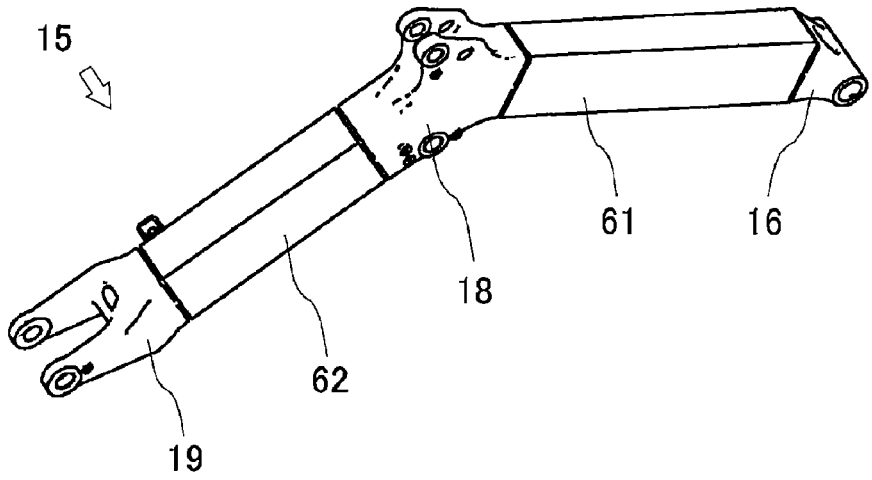
FIG. 5 is a perspective view showing a standard boom and a long front boom.
Figure 5:
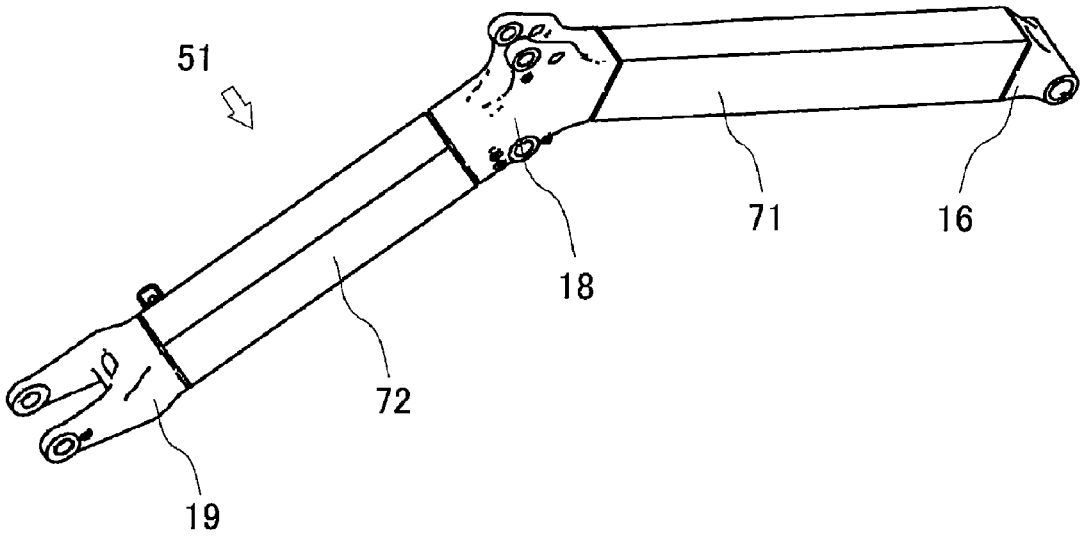
Figure 6:
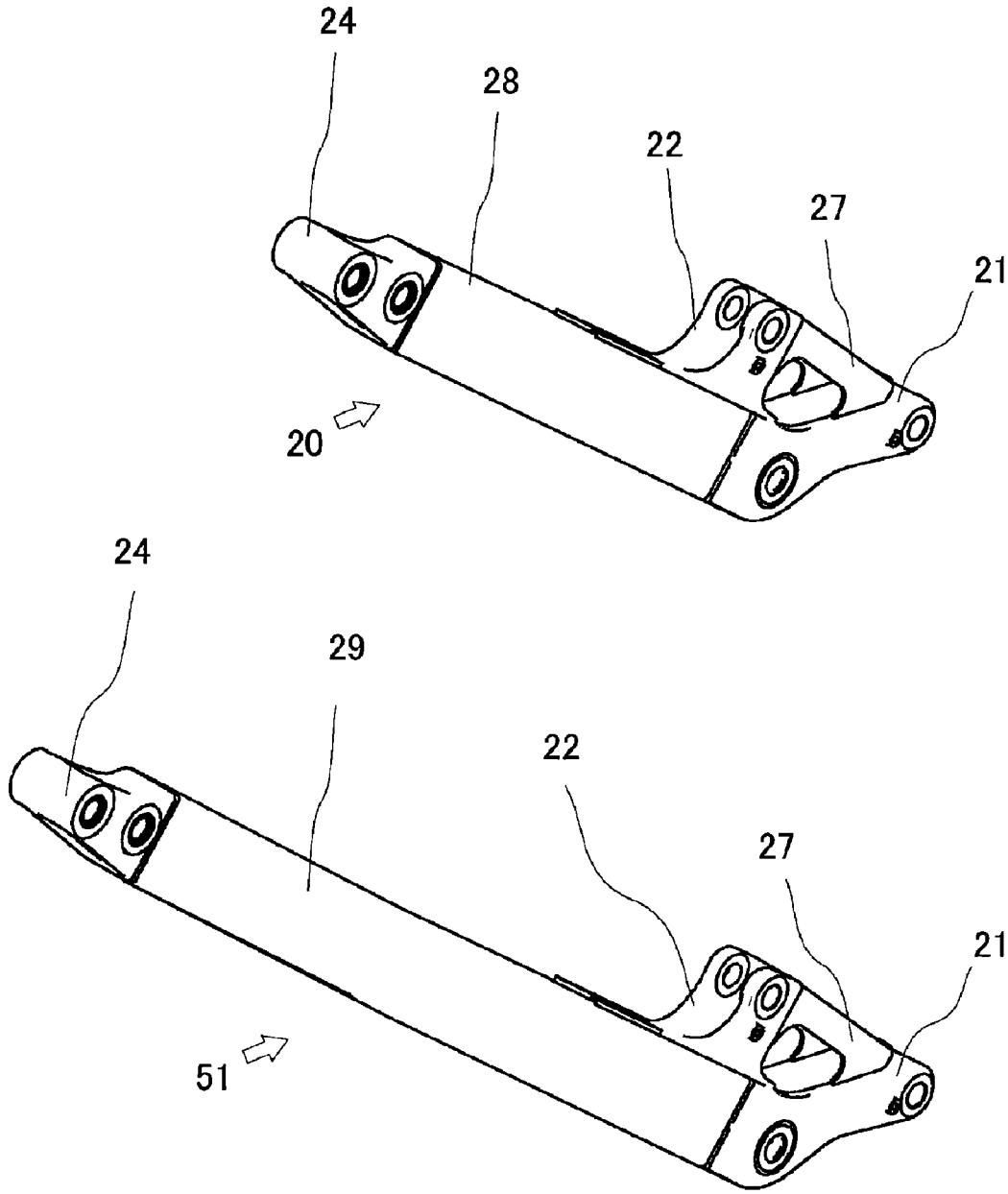
FIG. 6 is a perspective view showing a standard boom and a long front arm.

FIG. 4 is a perspective view showing a configuration of an arm and a cross-sectional view of a straight part according to the embodiment of the present invention. FIG. 5 is a perspective view showing a standard boom and a long front boom. FIG. 6 is a perspective view showing a standard boom and a long front boom.

As shown in FIG. 1, a power shovel 50 well known as an excavation machine is assumed as the embodiment of the present invention. The power shovel 50 is an excavation machine excavating earth and sand as an excavation machine. This power shovel 50 is a most popular hydraulic shovel excavation machine and can perform a loading operation mainly for an excavation operation for the earth and sand.

As shown in FIG. 1, the power shovel 50 is roughly configured to include a crawler-type traveling device 40, an upper rotational body 30 supported on a center of an upper portion of the crawler-type traveling device 40 to be transversely rotatable, and a working machine 10 attached to a transverse center of a front portion of the upper rotational body 30.

A blade 41 is vertically rotatably arranged on a longitudinal side of the crawler-type traveling device 40. As the crawler-type traveling device 40, a variable gauge crawler can be used, and stability can be ensured by widening an interval of the crawler during an operation.

An engine (not shown) is mounted on a rear upper portion of a vehicle body frame 31 of the upper rotational body 30, a rear portion of the engine is covered with a bonnet, which is not shown, and the vehicle body frame 31, and both side portions thereof are covered with covers 32, respectively. A driver's seat 33 is arranged between the covers 32 and above the engine. An operation lever, a lock lever and the like are arranged near a front or side portion of the driver's seat 33 and a pedal and the like are arranged on a step 34 in front of the driver's seat 33, thereby constituting a driving operation part 35. Further, a canopy 36 is arranged above or a cabin is arranged around the driving operation part 35.

As shown in FIG. 2, the working machine 10 is roughly configured to include a boom 15, an arm 20, and a bucket 25.

A device driving the boom 15, the arm 20, and the bucket 25 will now be described. A boom bracket 37 is transversely rotatably attached to a transversely central portion on a front end of the vehicle body frame 31 (see FIG. 1), and transversely rotated by a swing cylinder (not shown). A boom support point part 16 provided in a lower portion of the boom 15 is vertically (longitudinally) rotatably supported in an upper portion of the boom bracket 37. Further, to rotate the boom 15, a boom cylinder 17 interposes between a front portion of the boom bracket 37 and a front portion of a boom cylinder rod support point part 18 halfway along the boom 15. Moreover, to rotate the 20, an arm cylinder 23 interposes between the boom cylinder rod support point part 18 halfway along the boom 15 and an arm support point part 21 provided on a rear end portion of the arm 20. Besides, to rotate the bucket 25, a bucket cylinder 26 interposes between a bucket cylinder bottom support point 22 in a rear portion of the arm 20 and the bucket 25.

In this way, in the working machine 10, the boom 15 can be rotated by driving the boom cylinder 17 to expand or contract, the arm 20 can be rotated by driving the arm cylinder 23 to expand or contract, and the bucket 25 can be rotated by driving the bucket cylinder 26 to expand or drive.

These cylinders 17, 23, and 26 serving as hydraulic actuators and a rotation motor rotating the upper rotational body are configured to be driven by supplying thereto a pressure oil from a hydraulic pump (not shown) through a hydraulic hose by changing over a control valve (not shown) by a rotation operation for rotating the operation level, the pedal or the like provided in the driving operation part 13 (see FIG. 1).

As shown in FIG. 3, the boom 15 is bent forward in a portion halfway along the boom 15 and formed in to a generally "dogleg" shape in a side view. It is to be noted that FIG. 3 shows parts separate from one another so as to facilitate understanding of a configuration of the boom 15.

The boom 15 is configured to include the boom support point part 16, the boom cylinder rod support point part 18, an arm support point part 19, a first straight part (first general-purpose rectangular pipe) 61, a second straight part (second general-purpose rectangular pipe) 62, and the like. The first straight part 61 is arranged between the boom support point part 16 and the boom cylinder rod support point part 18 and the second straight part 62 is arranged between the boom cylinder rod support point part 18 and the arm support point part 19. The first and second straight parts 61 and 62 are fixedly attached therebetween by welding, respectively. The boom support point part 16, the boom cylinder rod support point part 18, and the arm support point part 19 are cast components by integral molding. On the other hand, as each of the straight parts 61 and 62, a metal general-purpose rectangular pipe transverse and longitudinal lengths of which are set to predetermined lengths (normalized) is used. In the present embodiment, identical general-purpose rectangular pipes are used as the first straight part 61 and the second straight part 62. Namely, as shown in FIG. 3, an AA' cross-sectional shape of the first straight part 61 is identical to a BB' cross-sectional shape of the second straight part 62 while the first straight part 61 and the second straight part 62 differ only in length. The boom 15 can be reduced in weight to some extent by configuring the cross-sectional shape of the second straight part 62 to be smaller than that of the first straight part 61.

A shaft hole **16*a* is opened transversely on a proximal portion side of the boom support point part 16 and the boom support point part 16 is pivotally supported in the upper portion of the boom bracket 37 by a pivoted spindle. The other end side (upper portion) of the boom support point part 16 is opened to have a rectangular shape to conform to a cross-sectional shape of the first straight part 61. An edge portion is formed on an outer circumference of this opening portion 16*b* so as to be able to fit one end of the first straight part 61** into the edge portion.

The boom cylinder rod support point part 18 is formed out of a rectangular pipe-shaped component having a portion halfway along the rectangular pipe-shaped component formed into a generally "dogleg" shape in a side view. The boom cylinder rod support point part 18 is configured so that an opening portion **18*a* on one end (in a lower portion) of the boom cylinder rod support point part 18 is formed into a rectangular shape to conform to the cross-sectional shape of the first straight part 61, and so that an edge portion is formed on an outer circumference of this opening portion 18***a* so as to be able to fit the other end of the first straight part 61 into the edge portion. An opening portion 18*b* on the other end (in an upper portion) of the boom cylinder rod support point part 18 is formed into a rectangular shape to conform to the cross-sectional shape of the second straight part 62. An edge portion is formed on an outer circumference of this opening portion 18*b* so as to be able to fit one end of the second straight part 62 into the edge portion. A shaft hole 18*c* is opened transversely in a portion vertically halfway along a front surface of the boom cylinder rod support point part 18, and configured so that a pivoted spindle can pivotally support a tip end of a piston rod of the boom cylinder 17.

Supporting convex portions 18*d* are formed in a portion vertically halfway along a rear surface side of the boom cylinder rod support point part 18, and shaft holes are opened transversely in the respective supporting convex portions 18*d* so that a pivoted spindle can support a bottom side of the arm cylinder 23.

The arm support point part 19 is configured so that a rectangular opening portion 19*a* conforming to the cross-sectional shape of the second straight part 62 is formed on a proximal portion side of the arm support point part 19, and so that an edge portion is formed on an outer circumference of this opening portion 19*a* so as to fit the other end (upper portion) of the second straight part 62 into the edge portion. Forked protruding portions 19*b* are formed on the other end (tip end) of the arm support point part 19, and shaft holes are transversely formed in the protruding portions 19*b*, respectively to enable a pivoted spindle to pivotally support a proximal portion side of the arm 20. By forming the outer circumference of the opening side of the support point part identical in shape to that of the straight part, the support point part can be connected to the straight part without differences in height, thereby making it possible to improve an external appearance.

To keep balance while the excavation machine operates and to resist a load during an excavation operation, it is considered that the boom needs to have a strength and to be reduced in weight. Conventionally, the boom configured to bond left and right side plates to upper and lower plates by welding and to have the rectangular cross section has been most popular.

As described in the present embodiment, the same general-purpose pipes are used for the straight parts 61 and 62, thereby making it possible to decrease the number of components (types of components) of the boom 15. Furthermore, the general-purpose rectangular pipes are generally inexpensive. Namely, component cost of the boom 15 can be reduced by decreasing the number of components and adopting the general-purpose rectangular pipes. Besides, it suffices to cut each general-purpose rectangular pipe only by a necessary length for working without a welding operation for forming the cross section as that according to the conventional technique, thereby making it possible to reduce manufacturing man-hours. In this way, manufacturing cost can be reduced by reducing the component cost and the manufacturing man-hours.

Similarly to the conventional technique, even if the general-purpose rectangular pipes are used for the respective straight parts 61 and 62, the boom 15 can be formed into a "dogleg" shape by adjusting angles of connected surfaces of upper and lower ends of the boom cylinder rod support point part 18. Furthermore, as for a central portion the necessary strength of which has been conventionally kept by making the cross-sectional area large, a necessary strength can be attained by making a cross-sectional area of the boom cylinder rod support point part 18 that is a cast component large.

As shown in FIG. 4, the arm 20 is roughly configured to provide support point parts in front and rear of a straight part 28, respectively. It is to be noted that FIG. 4 shows parts separate from one another so as to facilitate understanding of a configuration of the arm 20.

The arm 20 is configured to include the straight part 28, an arm support point part 21 and a bucket support point part 24 arranged on both sides of the straight part 28 and fixedly provided thereto by welding or the like, respectively, a bucket cylinder bottom support point part 22 provided on the straight part 28, an arm reinforcement 27 connecting the arm support point part 21 to the bucket cylinder bottom support point part 22, and the like. The arm support point part 21, the bucket cylinder bottom support point part 22, and the bucket support point part 24 are cast components by integral molding. A general-purpose rectangular pipe is used as the straight part 28. FIG. 4 shows a cross-sectional view of a CC' cross section of the straight part 28. Further, the arm reinforcement 27 is produced by conducting a bending work or the like on a sheet plate.

The arm support point part 21 is configured so that a shaft hole 21*a* is opened transversely on a proximal portion side of the arm support point part 21 to enable a pivoted spindle to pivotally support a tip end of a piston rod of the arm cylinder 23, and so that a shaft hole 21*b* is opened transversely in a portion halfway along the arm support point part 21 to enable a pivoted spindle to pivotally support the arm support point part 21 in an upper portion of the boom 15. The other end (tip end portion) of the atm support point part 21 is opened into a rectangular shape to conform to a cross-sectional shape of the straight part 28. An edge portion is formed on an outer circumference of this opening portion 21*c* so as to be able to fit one end of the straight part 28 into the edge portion.

The bucket support point part 24 is configured so that a rectangular opening portion 24*a* to conform to the cross-sectional shape of the straight part 28 is formed on a proximal portion side of the bucket support point part 24, and so that an edge portion is formed on an outer circumference of this opening portion 24*a* so as to be able to fit the other end (tip end) of the straight part 28 in the edge portion. The bucket support point part 24 is configured so that a shaft hole 24*b* is opened transversely on the other end (tip end) of the bucket support point part 24 to enable a pivoted spindle to pivotally support a proximal portion side of the bucket 25, and so that a shaft hole 24*c* is opened transversely in a portion halfway along the bucket support point part 24 so as to be able to pivotally support one end of a connection link 39 connected to a tip end of a piston rod of the bucket cylinder 26. By forming the outer circumference of the opening side of the support point part identical in shape to that of the straight part, the support point part can be connected to the straight part without differences in height, thereby making it possible to improve external appearance.

The bucket cylinder bottom support point part 22 is configured in an inverted U shape in a front view and configured to be fixedly provided on an upper surface of a rear portion of the straight part 28 by welding or the like. The bucket cylinder bottom support point part 22 is also configured so that a shaft hole is opened in an opening-side upper portion of the bucket cylinder bottom support point part 22 to enable a pivoted spindle to pivotally support a proximal portion side of the bucket cylinder 26. Furthermore, an upper portion of the bucket cylinder bottom support point part 22 is fixedly connected to an upper portion of the arm support point part 21 by the arm reinforcement 27 by welding or the like.

To keep balance while the excavation machine operates and to resist a load during the excavation operation, it is considered that the arm needs to have a strength and to be reduced in weight. Conventionally, the arm configured to bond left and right side plates to upper and lower plates by welding and to have the rectangular cross section has been most popular.

As described in the present embodiment, the general-purpose pipe is used for the straight part 28, thereby making it possible to decrease the number of components of the arm 20. Furthermore, the general-purpose rectangular pipe is generally inexpensive. Namely, component cost of the arm 20 can be reduced by decreasing the number of components and adopting the general-purpose rectangular pipe. Besides, it suffices to cut the general-purpose rectangular pipe only by a necessary length for working without a welding operation for forming a cross section as that according to the conventional technique, thereby making it possible to reduce manufacturing man-hours. In this way, manufacturing cost can be reduced by reducing the component cost and the manufacturing man-hours.

As for a boom-side portion the necessary strength of which has been conventionally kept by making a cross-sectional area of a boom-side large, a necessary strength can be attained by the arm support point part 21 and the bucket cylinder bottom support point part 22 that are cast components as well as the arm reinforcement 27.

The same general-purpose rectangular pipe as those used for the first straight part 61 and the second straight part 62 of the boom 15 can be used for the straight part 28 of the arm 20.

In this way, by producing the straight parts 28, 61, and 62 of the working machine 10 by cutting each of the same general-purpose rectangular pipes only by the necessary length, the manufacturing cost can be further reduced.

As shown in FIG. 5, a boom 51 (long boom) larger in entire length than the above-stated boom 15 (standard boom) is often provided in the power shovel 50. Since the boom or the arm is referred to as "front", an excavation machine including such a longer boom or arm than the standard boom or arm is generally referred to as "long front or high lift front". The long front is adopted to widen an operating radius or to conduct excavation at a deeper position whereas the high lift front is adopted to reach a higher position than usual.

In the present embodiment, the long boom 51 can be configured by straight parts 71 and 72 obtained by increasing lengths of the straight parts 61 and 62 of the standard boom 15, respectively, and the boom support point part 16, the boom cylinder rod support point part 18, and the arm support point part 19 similar to those of the standard boom 15.

Only by changing the lengths of the general-purpose rectangular pipes as stated above, a plurality of booms at lengths according to excavation machines on which the booms are mounted, respectively can be produced. Namely, it is possible to improve versatility of the boom for excavation machines of the same type and reduce the manufacturing cost entirely for the type of the machines.

However, if the first straight part 61 is extended, it is necessary to provide the support part supporting the tip end of the piston rod of the boom cylinder on an upper front surface of the first straight part 61 so as to use the same boom cylinder. If the second straight part 62 is extended, it is necessary to provide the bottom-side support part thereof in a rear upper portion of the second straight part 62 so as to use the same arm cylinder.

As stated so far, the boom in which the same boom support point part 16, the same boom cylinder rod support point part 18, and the same arm support point part 19 are used, in which the longitudinal length of any one of or each of the first straight part 61 and the second straight part 62 is changed, and which has the different entire length is attached to the boom bracket 37 and is configured to be operable. Therefore, only by changing the length of each of the general-purpose rectangular pipes, a plurality of booms at lengths according to excavation machines on which the booms are mounted, respectively can be produced. Namely, the versatility of the boom in the excavation machines of the same type can be improved.

As shown in FIG. 6, an arm 52 (long arm) larger in entire length than the above-stated arm 20 (standard arm) is often provided in the power shovel 50.

In the embodiment, the long arm 52 can be configured by a straight part 29 obtained by increasing the entire length of the straight part 28 of the standard arm 20, as well as by the arm support point part 21, the bucket cylinder bottom support point 22, and the bucket support point similar to those of the standard arm 20. It is preferable to change the length of the arm reinforcement 27 if it is necessary to do so.

In this way, only by changing the length of each of the general-purpose rectangular pipes, a plurality of booms at lengths according to excavation machines on which the booms are mounted, respectively can be produced. Namely, the versatility of the boom in the excavation machines of the same type can be improved and manufacturing cost of the overall excavation machines of the type can be reduced.

In the embodiment, the manufacturing cost can be reduced by using the general-purpose rectangular pipes for the straight parts 28, 61, and 62 of the boom 15 or the arm 20 in the power shovel 50, respectively. The present invention is not limited to the power shovel 50 but can be applied to other excavation machines each including the boom or the arm.

INDUSTRIAL APPLICABILITY

An example of using the present invention includes an excavation machine.

What is claimed is:

1. A boom for a working machine attached to an upper rotational body supported on a center of an upper portion of a traveling device to be transversely rotatable, the boom comprising:

a boom support point part;

a boom cylinder rod support point part having a first opening portion and a second opening portion, the second opening portion being oriented at an oblique angle with respect to the first opening portion;

an arm support point part; and first and second straight parts having said boom cylinder rod support point part therebetween; and an arm cylinder bottom support point provided at a convex portion projecting from a rear surface of said boom cylinder rod support point part, wherein:

each of said first and second straight parts has a rectangular cross section of constant transverse and longitudinal dimensions over an entire length, said first straight part is connected at one end thereof to said boom support point part, and at the other end thereof to said first opening portion of said boom cylinder rod support point part, and said second straight part is connected at one end thereof to said arm support point part, and at the other end thereof to said second opening portion of said boom cylinder rod support point part.

2. The boom according to claim 1, wherein the transverse and longitudinal dimensions of the rectangular cross section of said first straight part are identical to the transverse and longitudinal dimensions of the rectangular cross section of said second straight part.

3. The boom according to claim 1, wherein each of said first straight part and said second straight part is constituted by cutting a general-purpose rectangular pipe having a rectangular cross section of constant transverse and longitudinal dimensions over an entire length by an arbitrary length.

4. A working machine for attachment to an upper rotational body supported on a center of an upper portion of a traveling device to be transversely rotatable, the working machine comprising a boom and an arm, said boom including:

a first boom end part pivotally supported onto said upper rotational body;

a boom intermediate part having a first opening portion and a second opening portion, wherein said boom intermediate part bends to have an interior angle side and an exterior angle side so that said second opening portion is oriented at an oblique angle with respect to said first opening portion, and wherein said boom intermediate part has a boom cylinder rod support point at said interior angle side thereof and has an arm cylinder bottom support point at a convex projecting from said exterior angle side thereof;

a second boom end part; and first and second straight parts having said boom intermediate part therebetween, wherein each of said first and second straight parts has a rectangular cross section of constant transverse and longitudinal dimensions over its entire length, wherein said first straight part is connected at one end thereof to said first boom end part, and at the other end thereof to said first opening portion of said boom intermediate part, and wherein said second straight part is connected at one end thereof to said second boom end part, and at the other end thereof to said second opening portion of said boom intermediate part, and the arm including:

a first arm end part pivotally connected to said second boom end part of said boom;

a second arm end part having a bucket support point; and an arm extension part extending between said first and second arm end parts.

5. The working machine according to claim 4, wherein the transverse and longitudinal dimensions of the rectangular cross section of said first straight part are identical to the transverse and longitudinal dimensions of the rectangular cross section of said second straight part and said third straight part.

6. The working machine according to claim 4, wherein said arm extension part of said arm is a third straight part having a rectangular cross section of constant transverse and longitudinal dimensions over its entire length.

* * * * *